United States Patent [19]

Beck

[11] 4,229,894

[45] Oct. 28, 1980

[54] ILLUMINATED NUMBER DISPLAY DEVICE

[76] Inventor: John P. Beck, 2507 Glendale Way, Michigan City, Ind. 46360

[21] Appl. No.: 825,933

[22] Filed: Aug. 19, 1977

[51] Int. Cl.[2] ..... G09F 13/06

[52] U.S. Cl. ..... 40/579

[58] Field of Search ..... 40/579, 611, 447, 584, 40/541

[56] References Cited

U.S. PATENT DOCUMENTS

| | | | |
|---|---|---|---|
| 57,711 | 9/1866 | Harrison | 40/579 |
| 836,915 | 11/1906 | Bradshaw et al. | 40/579 |
| 936,234 | 10/1909 | Chirgwin | 40/579 |
| 1,075,793 | 10/1913 | Ross | 40/619 |
| 1,235,665 | 8/1917 | Dossert | 40/564 X |
| 1,633,785 | 6/1927 | Hotchner | 40/619 X |
| 1,754,067 | 4/1930 | Thomas et al. | 40/579 X |
| 1,837,894 | 12/1931 | Bosche | 40/447 X |
| 1,841,026 | 1/1932 | Greenstone | 40/579 X |
| 1,994,937 | 3/1935 | Berger | 40/584 X |
| 2,114,639 | 4/1938 | Preddey | 40/584 X |
| 2,168,223 | 8/1939 | Lauve | 40/579 |
| 2,191,353 | 2/1940 | Poblocki | 40/579 X |
| 2,200,339 | 5/1940 | Nelson et al. | 40/579 X |
| 2,310,600 | 2/1943 | Robinson | 40/579 X |
| 2,674,821 | 4/1954 | Sheinbart | 40/619 |
| 3,319,060 | 5/1967 | Bartley | 40/541 |
| 3,831,023 | 8/1974 | Coffman | 40/583 X |

FOREIGN PATENT DOCUMENTS

| | | | |
|---|---|---|---|
| 686916 | 4/1930 | France | 40/579 |
| 416351 | 6/1966 | Switzerland | 40/564 |

*Primary Examiner*—Louis G. Mancene
*Assistant Examiner*—Wenceslao J. Contreras
*Attorney, Agent, or Firm*—Fitch, Even, Tabin, Flannery & Welsh

[57] ABSTRACT

An illuminated number display device is disclosed which includes a generally rectangular housing having a front wall on which is mounted one or more number plates so that each number plate overlies an opening in the front wall. Each number plate defines a number visible in daylight and has a plurality of frustoconical light passages therethrough which outline the number and facilitate improved illuminated number display at night from a plurality of low energy light bulbs mounted internally of the housing so that the light from each bulb passes through at least two openings in the front wall and through the light channels in the corresponding number plates. Light diffuser plates are preferably disposed between the front wall openings and the light bulbs, and, optionally, over an opening in a bottom wall of the housing to provide downwardly directed auxiliary lighting.

8 Claims, 5 Drawing Figures

ILLUMINATED NUMBER DISPLAY DEVICE

The present invention relates generally to illuminated number display devices, and more particularly to a novel illuminated display device particularly adapted for identifying house numbers and the like and which employs novel display numbers and low energy light sources to provide improved low energy number illumination at night.

The use of illuminated number display devices for nighttime display of both residential and commercial address numbers is well known. Such devices generally provide identifying numbers which can be visually observed during daylight, and provide means for illuminating the numbers during nighttime either by light directing onto their outer surfaces or by a light disposed behind the numbers so that the numbers are illuminated in outline or silhouette fashion.

With the continuing national awareness of the need for conserving energy resources and the concerted efforts to accomplish energy conservation, it is desirable that all devices which use electrical energy be designed to minimize energy consumption, The present invention serves this continuing need by providing an illuminated number display device which operates on relatively low energy input while presenting a sharp distinct display highly visible during nighttime.

Accordingly, one of the primary objects of the present invention is to provide a novel illuminated number display device which provides an illuminated number display during nighttime through the use of low energy light sources cooperative with novel number plates having light passages or channels formed therethrough in number patterns.

Another object of the present invention is to provide an illuminated number display device wherein low energy illumination bulbs are selectively positioned to cause light to pass through specially configured light channels in number plates in a manner to maximize nighttime visibility of the numbers at low energy input levels to the bulbs.

A feature of the low energy illuminated number display device in accordance with the present invention lies in the provision of novel frustoconical light channels formed in number plates to outline desired numbers, and selective positioning of low energy light bulbs so as to maximize light emission from the light channels at low energy input levels to the light bulbs.

Further objects and advantages of the present invention, together with the organization and the manner of operation thereof, will become apparent from the following detailed description of the invention when taken in conjunction with the accompanying drawing wherein like reference numerals designate like elements throughout the several views, and wherein.

Figure 1:
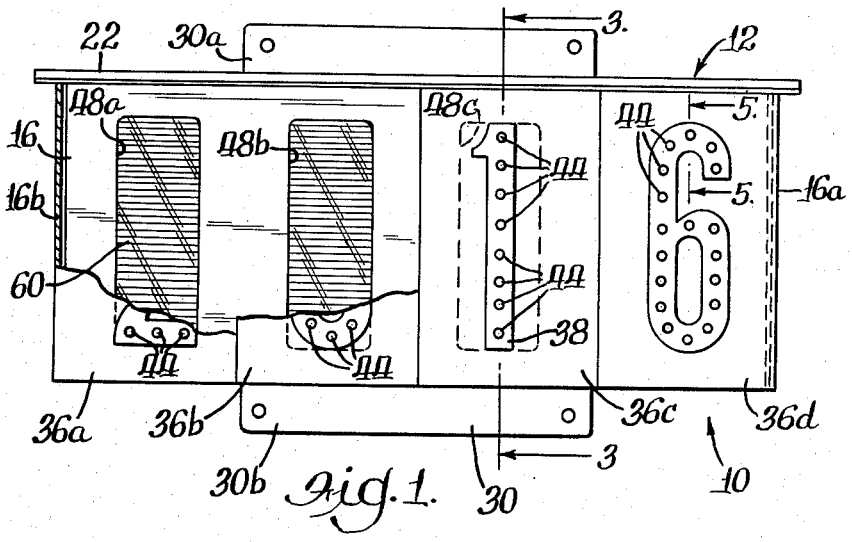
FIG. 1 is a front elevational view of an illuminated number display device constructed in accordance with the present invention, portions of the number plates being broken away for clarity.
Figure 4:
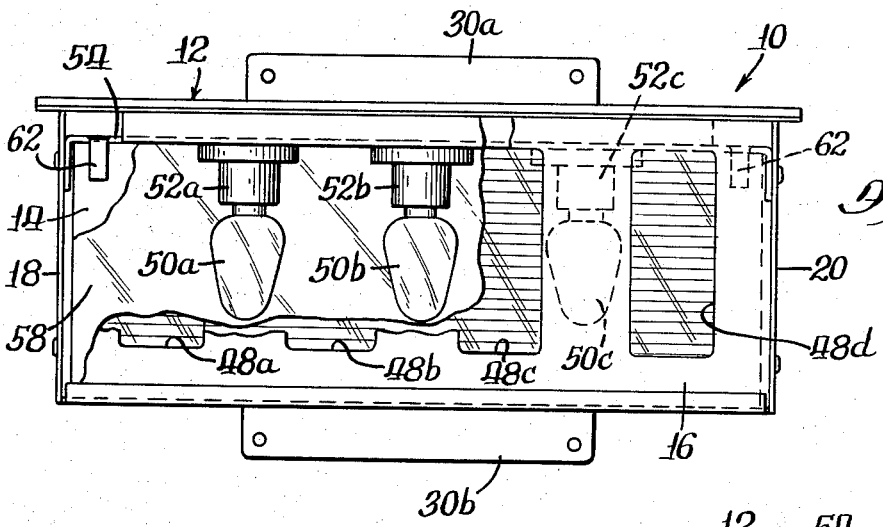
Figure 5:
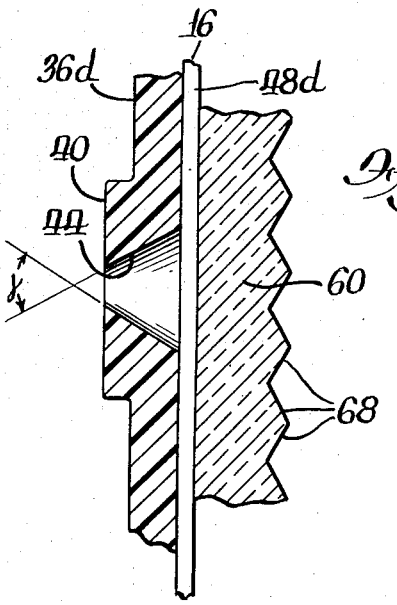

FIG. 4 is a front view of the display device of FIG. 1 but with the number plates removed and with portions of the front wall of the housing and diffuser plate broken away to show the positioning of the light bulbs; and FIG. 5 is an enlarged fragmentary sectional view, taken substantially along the line 5—5 of FIG. 1 looking in the direction of the arrows, showing a typical light channel in a number plate.

Referring now to the drawing, an illuminated number display device constructed in accordance with the present invention is indicated generally at 10. In its preferred embodiment, the display device 10 is adapted to be mounted in a suitable location on a home or commercial building and includes display indicia such as numbers representing the particular identifying street number address of the residence or business establishment. While the display device 10 is illustrated as displaying numbers, it will be understood that it might similarly be employed to display other indicia such as letters or combinations of letters and numbers.

The illuminated number display device 10 includes a housing, indicated generally at 12, which may be made of a suitable metallic, plastic or wood material and includes a back wall 14, a front wall 16, end walls 18 and 20, a top wall 22 and a bottom wall 24. In the illustrated embodiment, the back wall 14, end walls 18 and 20, and top and bottom walls 22 and 24 are formed from a single piece of noncorrosive sheet metal, which may have a painted finish or the like thereon, with the corners being smoothly rounded. The front wall 16 preferably comprises a removable U-shaped member having turned ends 16*a* and 16*b* adapted to be received outwardly over the end walls 18 and 20 and releasably secured thereto through suitable means such as screws indicated at 26 in FIG. 2.

Figure 2:
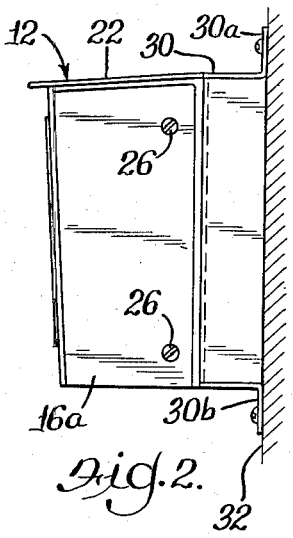
FIG. 2 is an end view of the display device of FIG. 1.
Figure 3:
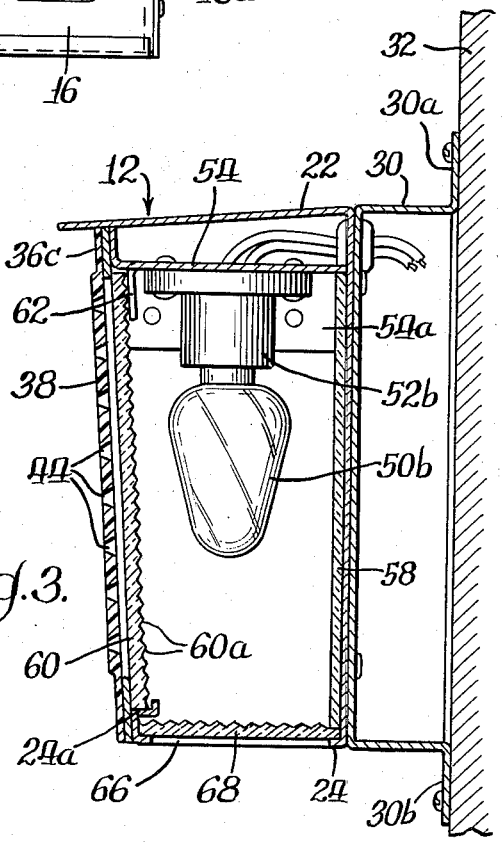
FIG. 3 is an enlarged transverse sectional view taken substantially along the line 3—3 of FIG. 1.

A mounting bracket 30 having upwardly and downwardly extending leg portions 30*a* and 30*b* is secured to the rear wall 14 of the housing and provides means for mounting the display device on a wall surface such as indicated at 32 in FIGS. 2 and 3. It is seen that the top wall 22 is inclined or sloped downwardly relative to a plane normal to the surface 32 on which the display device is mounted so as to facilitate runoff of rain water and the like, the top wall preferably overhanging the front wall 16 for this purpose. The housing 12 is preferably assembled so as to provide a substantially watertight casing resistant to entry of water and bugs.

The front wall 16 is adapted to have a plurality of display number plates mounted thereon, there being four rectangular display number plates 36*a–d* mounted on the front wall in the embodiment of FIG. 1. Each of the display number plates 36*a–d* has identifying indicia formed thereon in the form of a number which is raised from the remaining outer surface of the associated number plate, as represented by the raised surface 38 defining the number "1" on number plate 36*c* in FIGS. 1 and 3. Similarly, the display number plate 36*d* has the number "6" formed thereon defined by a surface 40 raised from the remaining outer surface of the number plate 36*d* . The numbers displayed on the various display number plates 36*a–d*, as represented by the raised surfaces 38 and 40, are preferably a different color, such as black, from the background surfaces of the respective display number plates, the background color preferably being white to provide good visual contrast in daylight with the various dark colored numbers.

In the illustrated embodiment, each of the number plates 36*a–d* is secured to the outer surface of the front wall 16 through a suitable adhesive applied to the rear surface of each of the number plates or is secured by other fastener means such as screws. Alternatively, the housing 12 could be provided with suitable upper and lower opposed open channels to receive the upper and lower edges of the number display plates. In either case, the individual number display plates facilitate applying combinations of numbers or letters as needed for identifying a particular residence or business establishment.

While the illustrated number display device employs four number display plates, it will be understood that a single number display plate could be provided having four identifying numbers formed thereon similar to the numbers shown in FIG. 1. It will also be understood that if fewer numbers than four are needed to provide house number identification, blank display plates may be selectively secured on the front wall 16 of the display device so that only the desired number will be seen in daylight and illuminated during nighttime.

In accordance with an important feature of the present invention, each of the number plates 36*a–d* has a plurality of light passages or channels 44 formed therethrough which provide an illuminated outline of the corresponding display numeral during nighttime operation of the display device. As seen in FIG. 1, the display numbers "1" and "6" on number display plates 36*c* and *d*, respectively, have light channels 44 spaced centrally along the respective numbers so that when light is passed through the light channels from the interior of the housing 10, the emitted light defines the respective display numbers. Referring to FIGS. 3 and 5, each of the light channels 44 is defined by a frustoconical surface having its axis perpendicular to the plane of its associated display plate. Each frustoconical light channel has its base portion opening outwardly toward the internal chamber in the housing 12, and has a conical angle, as represented by the Greek letter alpha in FIG. 5, of approximately 60°. As will be described more fully hereinbelow, it has been found that forming the light channels as generally cylindrical surfaces or as frustoconical surfaces having conical angles of approximately 90° does not provide a good light passage with low energy light bulbs positioned in accordance with the present invention as do the light channels 44 having conical angles of approximately 60°.

As best seen in FIGS. 1 and 4, the front wall 16 of the housing 12 has a plurality of equal size rectangular openings 48*a–d* formed therethrough which are equally laterally spaced and underlie the display number plates 36*a–b*. The openings 48*a–d* are of sufficient size so that the light channels 44 in the various number plates are in open light communication with the interior of the housing 12.

Another important feature of the illuminated display device 10 is the provision of low energy light sources interiorly of the housing 12 to provide the desired illumination through the light channels 44 at night. In the illustrated embodiment, three low energy light bulbs, indicated at 50*a–c* in FIG. 4, are supported within the housing 12 in respective light bulb sockets 52*a–c*, the light bulb sockets being suitably supported by a horizontal plate 54 secured to and between the end walls 18 and 20 through depending legs 54*a* and 54*b* formed integral with the plate 54, as best seen in FIG. 4. The light bulbs 50*a–c l comprise 7 watt bulbs conventionally identified as size "C", and are connected in parallel in a suitable electrical circuit facilitating connection of the respective light bulbs to a conventional* 110 v.a.c. power supply, thus eliminating the need for a step-down transformer or the like. The light bulbs 50*a–c*, which are frequently termed candelabra bulbs, provide a particular advantage over the light sources of the known prior art illuminated number display devices in that they establish an inexpensive source of light for the display device due to their low electrical energy requirements, and therefore contribute significantly to energy conservation.

It is seen in FIG. 4 that one less light bulb is provided than the number of number display plates 36*a–d*, and that each light bulb is mounted midway between two of the rectangular openings 48*a–d* and thus, midway between the two associated display numbers. If two number display plates are mounted on the front wall 16, as in a two digit identifying number, with their respective display numbers overlying two adjacent rectangular openings 48*a–d*, a single low energy light bulb need only be provided rearwardly of and midway between the two number display plates. Correspondingly, if three adjacent display numbers are mounted on the front wall 16, only two low energy light bulbs need be provided within the housing, each light bulb being centered between two adjacent number plates.

By centering each of the light bulbs 50*a–c* between two number display plates, uniform emission of light through the light channels 44 in each of the two adjacent number display plates is achieved. Where at least three display number plates and two light bulbs are employed, each display number receives light from two sources so that the light passing through each light channel 44 is a mixture of light from the two sources. As previously mentioned it has been found that frustocnical shaped light channels 44 having conical angles of 60°, as represented by the Greek letter alpha in FIG. 5, provide greater light passage efficiency through the light channels than can be obtained if the light channels are defined by cylindrical surfaces or by conical surfaces having conical angles close to 90°.

To maximize the light directed to the light channels 44 from the light bulbs 50*a–c*, a light reflective metallic reflector plate 58 is mounted within the casing 12 against the rear wall 14. Alternatively, the reflector plate may comprise a conventional silvered glass mirror having its mirror surface placed to reflect light from the light bulbs.

A translucent rectangular diffuser plate 60 of glass or other suitable material is preferably mounted within the housing 12 rearwardly of the front plate 10 so as to assist in diffusing light from the light bulbs 50*a–c* as it passes to the light channels 44. In the illustrated embodiment, the diffuser plate 60 is positioned interiorly of the front wall 16 against depending legs 62 formed downwardly from the plate 54, the lower edge of the diffuser plate resting on an upstanding flange 14*a* formed upwardly from the forward edge off the bottom wall 24. The diffuser plate 60 is of conventional design and has a serrated inner surface 60*a* which serves to diffuse the light rays impinging thereon from the low energy light bulbs 50*a–c*.

Preferably, the bottom wall 24 of the housing 12 has a generally rectangular opening 66 therein, as best seen in FIG. 3, over which is positioned a light diffuser plate 68. The opening 66 and diffuser plate 68 facilitate downward passage of light from the light bulbs 50*a–c* to provide auxiliary lighting as may be desired to illuminate a door or entrance area.

Having thus described a preferred embodiment of the illuminated number display device 10 in accordance with the present invention, it is seen that an improved illuminated number display device is provided which, through selective placement of low energy light bulbs in cooperation with specially configured light channels in the number plates, provides highly efficient low energy illumination of display numbers so as to produce sharp distinct illuminated numbers or the like during nighttime. The substantially sealed housing prevents access to the interior of the device by children with attendant safety advantages. By employing a number of light bulbs less than the number of number display plates and positioning of the light bulbs so that the light from each bulb passes through the light channels of at least two number plates, highly efficient illumination of the display numbers at low energy input is achieved, thus adding substantially to the conservation of energy.

The mixing of the light from two or more light sources and the diffusion of the light by the diffuser plate through the light channels provides numbers which are more readily readable at a distance. It is to be appreciated that the light is spread horizontally across a house number and across the horizontally extending light channels as well as spread vertically across the house number and the vertically extending light channels so that the entire house number outline is seen at a distance. If one removes the diffuser plate, then some of the light channels appear to have a higher intensity of light issuing therefrom than others making the entire house number more difficult to read. Therefore, it is not only the intensity of light that is provided with a fewer number of light bulbs but also a good mixture of uniform light intensity through substantially each one of the individual light channels in the sign.

The diffusion of the light and the mixing thereof along with a directing of the light allows low level light sources to be used to outline house numbers in a uniform manner and the perception thereof from a relatively long distance.

What is claimed is:

1. A device for displaying a visually observable number or the like during daylight and displaying the same but illuminated number or the like during nightime, said device comprising a housing having an interior chamber defined in part by a front wall, said front wall having at least one opening therethrough in light communication with said interior chamber, light producing means supported within said chamber and adapted to be electrically energized to emit light through said opening, and a plurality of discrete, individual indicia display plates mounted on said front wall, each of said indicia display plates having means thereon for attaching the same to said housing and in position in front of said opening and for juxtaposition next to adjacent indicia display plates to provide the visually observable number, each of said indicia display plates having an identifying indicia thereon visible in daylight and each having a plurality of light transmitting channels therethrough overlying said opening and disposed in a pattern providing an illuninated display of the same identifying indicia visible during nighttime when said light producing means is electrically energized, each of said light transmitting channels being an unobstructed opening and having an axis disposed substantially perpendicular to the plane of said display member, each said opening being defined by a frustoconical surface being integral with said plate and having a larger diameter opening facing the interior of the housing and a smaller diameter opening facing outwardly of the housing, said housing including a bottom wall having an opening therethrough, and including a light diffusing plate supported by said housing in overlying relation to said opening in said bottom wall so that light emitted from said light producing means is transmitted through said opening in said bottom wall to provide general illumination beneath the device.

2. A display device as defined in claim 1 wherein said light producing means includes a plurality of light bulbs equal in number to one less than the number of openings in said front wall, each of said light bulbs being disposed substantially midway between each two openings in said front surface so that light emitted from each of said bulbs passes through the light transmitting channels in two adjacent ones of said display plates.

3. A display device as defined in claim 2 wherein said light bulbs comprise low energy light bulbs.

4. A display device as defined in claim 1 wherein said frustoconical light transmitting channels have conical angles of approximately 60°.

5. A display device as defined in claim 1 wherein said means for attaching each of said display plates has comprises an adhesive surface thereon facilitating attachment to said front wall of said housing.

6. A display device as defined in claim 1 wherein said housing is generally rectangular and includes a top wall inclined downward relative to horizontal when said device is mounted in an upright position.

7. A display device as defined in claim 1 including a reflector plate disposed within said chamber in substantially parallel relation to said front wall thereof, said reflector plate being disposed so that said light emitted from said light producing means is reflected from said reflector plate toward said front wall of said housing.

8. A display device as defined in claim 1, further including a light diffusing plate disposed between said openings in said front wall and said light producing means.

* * * * *